United States Patent [19]

Arakawa

[11] Patent Number: 4,716,672

[45] Date of Patent: Jan. 5, 1988

[54] ORNAMENTAL BODY

[76] Inventor: Shinichiro Arakawa, c/o Wid Co., Ltd., 5-46-5, Asakusa, Taito-Ku, Tokyo 111, Japan

[21] Appl. No.: 826,768

[22] Filed: Feb. 6, 1986

[30] Foreign Application Priority Data

Mar. 20, 1985 [JP] Japan ..... 60-54347

[51] Int. Cl.[4] ..... G09F 19/00

[52] U.S. Cl. ..... 40/615

[58] Field of Search ..... 40/616, 615, 582, 219, 40/900; 428/913.3, 542.2, 29, 30, 209

[56] References Cited

U.S. PATENT DOCUMENTS

| | | | |
|---|---|---|---|
| 1,128,979 | 2/1915 | Hess | 40/616 |
| 2,116,471 | 5/1938 | Nelson | 40/615 |
| 3,386,199 | 6/1968 | Nagatsuka | 40/615 |
| 4,138,515 | 2/1979 | Dial | 40/582 |
| 4,192,091 | 3/1980 | Hawes | 40/615 |
| 4,597,210 | 7/1986 | Kitrell | 40/542 |
| 4,648,189 | 3/1987 | Michel | 40/615 |

*Primary Examiner*—Gene Mancene
*Assistant Examiner*—Cary E. Stone
*Attorney, Agent, or Firm*—Holman & Stern

[57] ABSTRACT

An ornamental body comprises a transparent layer and a metal foil laminated with the transparent layer. A visible image such as scenery or the like is formed upon a laminated surface of the transparent layer or the metal layer by photography printing. The visible image is characterized by its vivid color contrast and stereoscopic appeal.

4 Claims, 5 Drawing Figures

ORNAMENTAL BODY

BACKGROUND OF THE INVENTION (1) Field of the Invention

This invention relates to an ornamental body which is used for various kinds of displays, ornamental frame or the like. More particularly, it can display various photos, pictures, paintings, patterns very vividly in a stereoscopic manner.

(2) Description of Prior Art

Conventionally, when observing for example a photographic landscape, it is printed on a sensitive paper. If a large number of such photographic landscapes are required, they are printed by known printing means.

In any case, a portion of a photographic image on the sensitive paper is based on a white color paper. Namely, any ordinary photographic paper is of a white color one. When one wishes to print a photograph on a non-white color paper, its printing portion must be white-colored.

However, when printing a photographic image on a white color portion, the inconvenience is that a light reflection efficiency is still insufficient, so that a highly verisimilitude or stereoscopic image has not been obtained. To solve such inconvenience, an image is photographed and printed, for example, on a glass or a plastic material, and then the photographed image is reflected by a back illumination. However, its brightness is increased, but a color contrast is unsuitable and unclear. Further, such printing and illumination process needs a large-sized apparatus. Still further, its commercial utilization is limited and production cost is expensive. Because such photograph is usually inserted in a wall body for the purpose of advertising.

BRIEF SUMMARY OF THE INVENTION

It is accordingly a general object of this invention to provide an ornamental body, in which a visible image has a vivid color contrast and a stereoscopic appeal.

More specifically, the ornamental body comprises a transparent layer and a metal foil laminated with the transparent layer, in which a visible image such as scenery or the like is formed upon a laminated surface of said transparent layer or said metal layer by photographic means, printing means or the like.

Other features and advantages of the invention will be apparent from the following description taken in connection with the accompanying drawings.

BRIEF DESCRIPTION OF THE ACCOMPANYING DRAWINGS

PREFERRED EMBODIMENTS OF THE INVENTION

A preferred embodiment of this invention will be described with reference to FIGS. 1 and 2.

Figure 1:
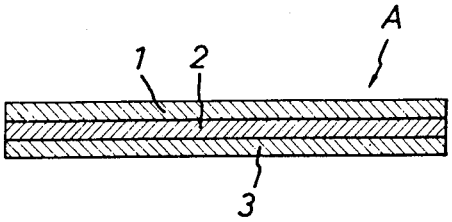
FIG. 1 is a section view of an ornamental body according to this invention.
Figure 2:
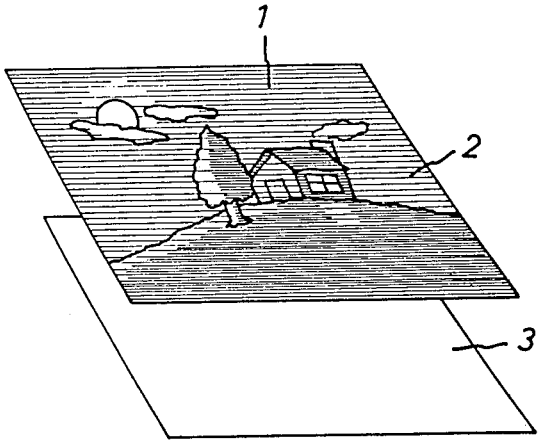
FIG. 2 is a view showing an example of a manufacturing process of this invention.

In FIG. 1 there is shown an ornamental body A according to this invention, which comprises a transparent plastic film 1 (upper layer), a photographic layer 2 (intermediate layer) formed on a rear surface of the transparent plastic film and a metal foil 3 (lower layer) backed and closely fitted with the photographic layer 2.

The photographic layer 2 formed on the rear surface of the transparent plastic film 1 may be made by an ordinary photographic means, i.e. development and printing by application of a sensitizer or a normal printing means. However, in either case it is absolutely required to expose a photographic image directly upon a transparent layer. The photographic image must not be exposed on any white color layer. Namely, the transparent layer must be formed by removing any white color.

The metal foil 3 backed with the photographic layer 2 is a non-glossy aluminum foil.

The aluminum foil as a finished product is provided with a glossy surface on one surface and a non-glossy surface on the other surface. The non-glossy surface is of a diffused reflection property in case of light reflection. According to this embodiment, the non-glossy surface of the aluminum foil is adhered to the photographic film 1 by a suitable adhesive.

Figure 3:
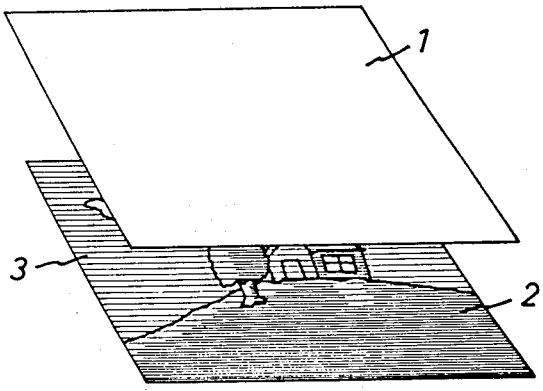
FIG. 3 is a view showing another example of the manufacturing process of this invention.

As described above, a photographic image or picture as a visible image is fitted between the transparent plastic film 1 and the aluminum foil 3. However, such a photographic image or picture may be formed immediately upon the non-glossy surface of the aluminum foil 3 and then laminated with the transparent plastic film 1 or coated with a suitable transparent agent. (Refer to FIG. 3.)

In this embodiment the visible image is a photographic one, but it may be pictures, paintings or the like by printing means or direct painting or drawing. Further, if any visible image will be formed by waterproof or wheatherproof means, it is not always necessary to provide the transparent plastic film 1.

A function of the ornamental body according to this invention will now be described.

Since a visible image is formed upon the non-glossy surface of the aluminum foil 3, an incident light is reflected in an overall direction upon a bright portion or light-reflective portion of the visible image such as a photo, a picture or the like, while the other portion of the visible image is not reflected since the light cannot be transmitted to the aluminum foil 3. As a result, a light contrast of the ornamental body A becomes very vivid. For example, in case of a night view photographic image, a shiningly bright portion can be relieved vividly in a stereoscopic manner.

Figure 4:
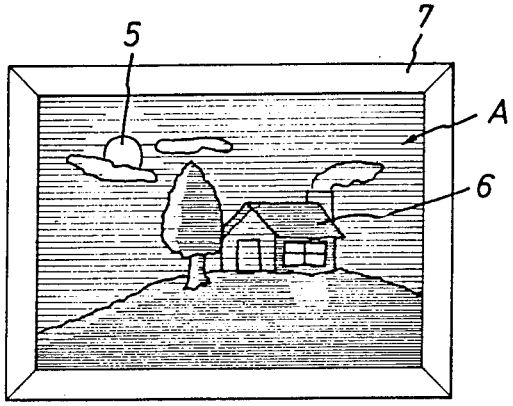
FIG. 4 is a front view showing a visible effect in case the ornamental body of this invention is set in a frame.
Figure 5:
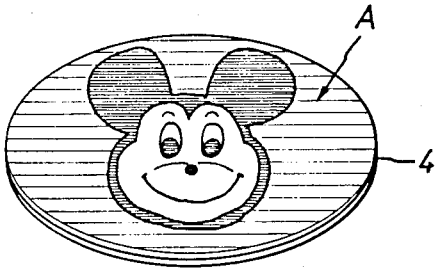
FIG. 5 is a perspective view of an embodiment of the ornamental body which is placed on a coaster 4 by cutting it in a circular form.

In FIG. 4 there is shown a night view example, in which the ornamental body A is set in a frame 7. In this case, a moon 5 and a window portion of a house 6 is reflected effectively and vividly like an actual night view. Even if the visible image is not a night view, it has a clear color contrast.

Accordingly, I can conclude that the ornamental body of this invention has a very vivid visible image, so that its visible appeal is very remarkable. In addition, since it can be produced at a low cost and by simple means and has high durability, it can be applied for various fields.

It is further understood by those skilled in the art that the foregoing description is a preferred embodiment of the disclosed device and that various changes and modifications may be made in the invention without departing from the spirit and scope thereof.

What is claimed is:

1. An ornamental body comprising a transparent layer and a metal foil laminated with said transparent layer the transparent layer and the metal foil each having an outer surface and an inner laminated surface, a visible image such as a scenery or the like being formed upon the laminated surface of one of said transparent layer and said metal foil by photographic means, printing means or the like wherein said metal foil is an aluminum foil and said laminated surface of said foil is a non-glossy surface having a diffused reflection property.

2. An ornamental body as claimed in claim 1, in which said transparent layer is a plastic film.

3. An ornamental body as claimed in claim 1, in which said visible image is a photographic image.

4. An ornamental body as claimed in claim 1, in which said visible image is a picture.

* * * * *